US007235518B2

(12) United States Patent
Brush et al.

(10) Patent No.: US 7,235,518 B2
(45) Date of Patent: Jun. 26, 2007

(54) FABRIC CARE COMPOSITIONS COMPRISING HUEING DYE

(75) Inventors: Lisa Grace Brush, Cincinnati, OH (US); Errol Hoffman Wahl, Cincinnati, OH (US); Jodi Lee Brown, Cincinnati, OH (US); Marena Dessette Brown, Cincinnati, OH (US); Shulin Larry Zhang, West Chester, OH (US); Michael David Cummings, West Chester, OH (US); Eugene Steven Sadlowski, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/244,774

(22) Filed: Oct. 6, 2005

(65) Prior Publication Data

US 2006/0079438 A1 Apr. 13, 2006

Related U.S. Application Data

(60) Provisional application No. 60/687,582, filed on Jun. 3, 2005, provisional application No. 60/617,613, filed on Oct. 8, 2004.

(51) Int. Cl.

| | |
|---|---|
| ***C11D 17/00*** | (2006.01) |
| ***C11D 3/42*** | (2006.01) |
| ***C11D 3/00*** | (2006.01) |
| ***C11D 7/18*** | (2006.01) |
| ***C11D 7/54*** | (2006.01) |

(52) U.S. Cl. ..... 510/343; 510/326; 510/348; 510/373; 510/419

(58) Field of Classification Search ..... 510/419, 510/516, 521, 522, 373, 330, 341, 343
See application file for complete search history.

(56) References Cited

U.S. PATENT DOCUMENTS

| | | | | |
|---|---|---|---|---|
| 3,748,093 | A * | 7/1973 | Gangwisch et al. | 8/137 |
| 4,151,097 | A * | 4/1979 | Nelson | 510/524 |
| 4,832,984 | A * | 5/1989 | Hasegawa et al. | 427/161 |
| 5,332,581 | A * | 7/1994 | Yoshihara et al. | 424/70.1 |
| 5,429,841 | A * | 7/1995 | Batlaw et al. | 427/288 |
| 5,853,430 | A * | 12/1998 | Shindo et al. | 8/137 |
| 6,153,364 | A * | 11/2000 | Goswami et al. | 430/434 |
| 6,846,333 | B2 * | 1/2005 | Legrand et al. | 8/405 |
| 6,916,344 | B1 * | 7/2005 | Allard et al. | 8/405 |
| 2004/0221400 | A1 * | 11/2004 | Cotteret et al. | 8/405 |
| 2005/0148486 | A1 * | 7/2005 | Schramm et al. | 510/419 |

FOREIGN PATENT DOCUMENTS

| | | | |
|---|---|---|---|
| WO | WO 94/10285 | A | 5/1994 |
| WO | WO 01/34743 | A | 5/2001 |
| WO | WO 03/060047 | | 7/2003 |
| WO | WO 03/097776 | A | 11/2003 |
| WO | WO 2005/068596 | | 7/2005 |

OTHER PUBLICATIONS

International Search Report, PCT/US2005/035889, 2 pages.

* cited by examiner

*Primary Examiner*—Douglas McGinty
*Assistant Examiner*—John M. Petruncio
(74) *Attorney, Agent, or Firm*—Mark A. Charles; David V. Upite; Kim W. Zerby

(57) ABSTRACT

Fabric conditioning compositions comprising a fabric care active and a hueing dye, wherein the hueing dye exhibits a hueing efficiency of at least about 20 according to the Hueing Efficiency Test method; and a Wash Removal Value from about 50% to about 98%, are useful in mitigating the discoloration of white and other light colored fabrics.

9 Claims, No Drawings

FABRIC CARE COMPOSITIONS COMPRISING HUEING DYE

CROSS REFERENCES TO RELATED APPLICATIONS

This application claims priority to U.S. Provisional Application Ser. No. 60/687,582, filed Jun. 3, 2005, which claims priority to U.S. Provisional Application Ser. No. 60/617,613, filed Oct. 8, 2004, the disclosure of which is incorporated by reference herein.

FIELD OF INVENTION

The present invention relates to fabric conditioning compositions comprising a fabric care active and a hueing dye.

BACKGROUND OF THE INVENTION

Wear and laundering of fabric articles, and particularly white fabric articles, can result in a discoloration from the original fabric color. For example, white fabrics which are repeatedly laundered can exhibit a yellowing in color appearance which causes the fabric to look older and worn. This can be especially true for cotton and cotton containing fabrics. Treatment of fabrics with conventional rinse added fabric conditioning compositions containing cationic softener actives can cause yellowing of fabrics over time with repeated use. To overcome the undesirable yellowing of white fabrics, and similar discoloration of other light colored fabrics, some fabric conditioning compositions include a hueing or bluing dye which attaches to fabric during the laundry wash and/or rinse cycle.

However, after repeated laundering of fabric with a fabric conditioning composition containing a hueing dye, the hueing dye can tend to accumulate on the fabric, giving the fabric a bluish tint. Such repeated laundering of white fabric articles tends to give the articles a blue, rather than white, appearance. To combat this accumulation of hueing dyes on fabric, chlorine treatments have been developed. While the chlorine treatment is effective to remove accumulated hueing dyes, the chlorine treatment is an additional and often inconvenient step in the laundry process. Additionally, chlorine treatment involves increased laundering costs, is harsh on fabrics, and can also cause fabric yellowing and therefore undesirably contributes to increased fabric degradation. Alternatively, hueing dyes in fabric conditioning compositions have been selected to minimize the build-up of an undesirable tint, but then they do not provide a consumer noticeable whitening benefit.

Similarly, upon laundering of fabric with a fabric conditioning composition containing a hueing dye, fabric staining by the hueing dye can occur. Fabric staining can occur through the normal use and misuse of the fabric conditioning composition. For example, fabric staining can occur when the fabric conditioning composition comprising a hueing dye is poured directly onto wet fabrics. Direct contact between the fabric conditioning composition and wet fabric can also occur after the spin cycle following the wash cycle before sufficient water is present to fully disperse the composition. In such cases, a high level of hueing dye in a relatively small area of fabric results in a visibly noticeable stain on the fabric. To remove the stain, the fabric must be rewashed. Likewise, to avoid the possibility of creating a stain on garments, hueing dyes have been selected in the past to minimize fabric staining, but then they do not provide a consumer-noticeable whitening benefit.

Accordingly, a need exists for improved fabric conditioning compositions which can counter the undesirable yellowing of white fabrics and similar discoloration of other light colored fabrics without causing the build-up of an undesirable tint or the creation of undesirable stains on fabric.

SUMMARY OF THE INVENTION

A first aspect of the invention provides a fabric conditioning composition comprising: a fabric care active; and a hueing dye, wherein the hueing dye exhibits a Hueing Efficiency Value of at least about 20 and a Wash Removal Value from about 50% to about 98%.

Another aspect provide a composition according to the first aspect, wherein the hueing dye also have a Staining Potential Score less than about 10.

Another aspect of the invention further comprises a Stain-Reduction Agent that reduces the Staining Potential Score of a fabric conditioning composition when the composition is placed in direct contact with a wet fabric.

Another aspect of the invention provides a method for making a composition comprising the step of combining a first composition to a second composition; wherein the first composition comprises disodium 4,4'-bis-(2-sulfostyryl) biphenyl and an ethoxylated monoalkyl quaternary compound; and wherein the second composition comprises a fabric care active.

Another aspect of the invention provides for a method of treating a fabric in the rinse cycle of the laundry process with a composition of the present invention, wherein the concentration of the hueing dye in the rinse water is from about 1 parts per billion (ppb) to about 600 ppb.

Another aspect of the invention provides a composition comprising a cationic polymer-anionic brightener complex.

DETAILED DESCRIPTION OF THE INVENTION

Hueing Dyes

One aspect of the invention provides a fabric conditioning composition comprising a hueing dye. Hueing dyes act to improve the whiteness appearance of dingy white garments or preserve whiteness appearance by compensating for the yellowish appearance of the fabric by addition of a complementary color to the fabric and thus the undesired yellow shade is less noticeable or not noticeable at all. Typically water soluble blue and violet dyes are used as hueing agents in the present invention at levels in a fabric softening rinse added composition from about 0.00001 wt. % to about 1 wt. %, preferably from about 0.0003 wt. % to about 0.03 wt. %.

However, selection of the proper hueing dye is critical. Some dyes will build-up on fabrics after repeated use of a rinse added fabric conditioning composition, and white garments will start to appear blue or take on a definite blue hue. Other dyes are not retentive enough when delivered from a fabric conditioning composition, and they never provide any noticeable whitening benefit on dingy white fabrics, even after repeated use. Dyes can stain fabrics if the composition comes in direct contact with either wet or dry fabrics and is not rinsed out which leaves colored spots. Additionally, the dye may not leave a consumer-acceptable hue; for example green and blue-green hues generally do not boost whiteness impression and are not favored by the consumer. Optical brighteners (fluorescent whitening agents) can additionally be used in combination with a hueing dye of this invention to give an improved, even a synergistic, whitening effect to dingy white fabrics.

Hueing Efficiency

One aspect of the invention provides a fabric conditioning composition comprising a hueing dye, wherein the hueing dye exhibits "Hueing Efficiency Value" of at least about 20, preferably from about 25 to about 50

Without wishing to be bound by theory, the Hueing Efficiency Value provides an indication of a hueing dye's ability to efficiently tint fabrics and therefore indicates the likelihood that a hueing dye will provide a noticeable change in fabric appearance. The methodology for determining the Hueing Efficiency Value is herein provided. Generally, under this method, the Hueing Efficiency Value of a hueing dye is measured by comparing a fabric sample rinsed in a solution containing no hueing dye with a fabric sample rinsed in a solution containing the hueing dye, and determining if the hueing dye is effective for providing the desired hueing efficiency as determined by taking a color reading on a spectrophotometer, as described herein below. Specifically, a 25 cm×25 cm fabric piece of 16 oz/linear yard combed cotton heavy interlock knit (obtained from Test Fabrics, P.O. Box 26, Weston, Pa., 18643) is employed (hereinafter "Fabric Sample") with and without brightener. The Fabric Sample is rinsed in a solution mimicking the rinse cycle of a typical U.S.A. laundry machine. To this end, the Fabric Samples are placed in a control beaker containing control rinse solution and an experimental beaker containing experimental rinse solution, wherein the only difference between the two solutions is the experimental rinse solution contains the hueing dye in question (about 30 parts per million) and the control rinse solution does not contain the hueing dye in question. Both the control rinse solution and experimental rinse solution contain: (a) 788 mL of distilled water; (b) 0.38 g of the final fabric conditioning composition as set forth in Example XXIII (minus the Liquitint Violet CT dye); and (c) 0.08 g of AATCC Standard Reference Liquid Laundry Detergent as set forth in Table I (herein below) and as referenced in the Technical Manual of the American Association of Textile Chemists and Colorists (AATCC), 2004, Vol. 79, p. 401 (hereinafter referred to as the "AATCC Detergent"). One skilled in the art will appreciate that the AATCC Detergent is used to mimic the typical detergent carryover from the wash to rinse cycle. Further, a typical experimental rinse solution contains 12 mL of a 2000 ppm hueing dye solution, to give 30 ppm hueing dye in the rinse solution. The control rinse solution adds 12 mL of distilled water or appropriate diluent/processing aid used to make the stock dye solution. A first Fabric Sample is rinsed in the control beaker containing the control rinse solution and a second Fabric Sample is rinsed in the experimental beaker containing the experimental rinse solution. Both Fabric Samples are agitated occasionally by hand with a glass stir rod for 30 minutes at ambient room temperature. The Fabric Samples are then squeezed of excess water by hand and hung to air dry in subdued light (i.e., without direct light). One skilled in the art will appreciate that direct light may degrade some hueing dyes and thus should be avoided.

After drying each Fabric Sample, the Hueing Efficiency Value, $DE^*_{eff}$, is assessed by the following equation:

$$DE^*_{eff}=((L^*_c-L^*_s)^2+(a^*_c-a^*_s)^2+(b^*_c-b^*_s)^2)^{1/2}$$

wherein the subscripts "c" and "s" respectively refer to the "L*," "a*," and "b*" values measured for: control conditions, i.e., the Fabric Sample rinsed in the control rinse solution; and experimental conditions, i.e., the Fabric Sample rinsed in the experimental rinse solution. The L*, a*, b* value measurements are carried out using a Hunter Color QUEST spectrophotometer (Model #CQ45/0 SAV), with D65 illumination, 10° observer (UV filter excluded). These color measurements are measured with reflectance using the color scale CIE L*a*b*. In one embodiment, the hueing dye suitable for use in the present fabric conditioning compositions exhibits a hueing efficiency of at least about 20, preferably from about 25 to about 50. In one embodiment, the Hueing Efficiency Value is from about 20 to about 30, alternatively from about 25 to about 35, alternatively from about 30 to about 45, alternatively from about 25 to about 45, alternatively from about 30 to about 50, and alternatively from about 35 to about 45.

TABLE I

Composition of AATCC Detergent.

| Ingredient | Weight percent |
|---|---|
| C11.8 linear alkylbenzene sulfonic acid[1] | 12.00 |
| Neodol 23-9 (Shell) | 8.00 |
| citric acid | 1.20 |
| C12–14 fatty acid[2] | 4.00 |
| sodium hydroxide[3] | 2.65 |
| Ethanolamine | 0.13 |
| borax (neutralized boric acid) | 1.00 |
| DTPA[4] | 0.30 |
| 1,2-propanediol | 8.00 |
| Tinopal AMS-GX (Ciba) | 0.04 |
| Water | Balance |

[1]11.8 is the average number of carbons on the alkyl chain
[2]derived from natural coconut oil
[3]formula pH adjusted to 8.5
[4]diethylenetriaminepentaacetic acid, pentasodium salt Wash Removal Value Another aspect of the invention provides for a fabric conditioning composition comprising a hueing dye that exhibits a "Wash Removal Value" in the range of from about 50% to about 98%, preferably from about 60% to about 95%.

Without wishing to be bound by theory, the Wash Removal Value provides an indication of a hueing dye's resistance to build up on a fabric and therefore indicates that the hueing dye, although effective for tinting, will not cause undesirable hueing of fabric after repeated rinsings. The methodology for determining the Wash Removal Value is herein provided. Fabric Samples resulting from the test for determining the Hueing Efficiency Value (described above) are resized to 5 cm×15 cm and are washed in a Launderometer (LP2 Launder-Ometer and Lab Dyeing System, Atlas Textile Test Products) according to AATCC Test Method 61–2003, Test No. 2A (referencing Technical Manual of the American Association of Textile Chemists and Colorists (AATCC), 2004, Vol. 79, p. 90–94). The detergent used in the solution is the same AATCC Detergent as used in the hueing efficiency test, as set forth in Table I. Test conditions in each canister include 150 mL of wash solution with 0.15 wt. % of detergent, 49° C., 50 steel balls (each ball weighs about 1.076 g and is about 6 mm in diameter), and a wash time of 45 minutes.

After being removed from the Launderometer canisters, Fabric Samples are rinsed briefly (about 5 seconds) under cold running tap water, excess water is removed by blotting, and then the Fabric Samples are air dried in subdued light. The amount of residual coloration is assessed by measuring the $DE^*_{res}$, given by the following equation:

$$DE^*_{res}=((L^*_c-L^*_s)^2+(a^*_c-a^*_s)^2+(b^*_c-b^*_s)^2)^{1/2}$$

wherein the subscripts "c" and "s" respectively refer to the "L*," "a*," and "b*" values measured for: the control conditions, i.e., the Fabric Sample is rinsed in the control rinse solution during the Hueing Efficiency Value test and then is washed in the Launderometer, rinsed, and dried; and experimental conditions, i.e., the Fabric Sample is rinsed in the experimental rinse solution during the Hueing Efficiency Test and then is washed in the Launderometer, rinsed, and dried. These measurements are carried out using the same Hunter Color QUEST as described in the Hueing Efficiency Test method (described above). The Wash Removal Value for the dye is then calculated according to the formula:

$$\text{Wash Removal Value}=100\times(1-DE^*_{res}/DE^*_{eff}).$$

In one embodiment, the hueing dye suitable for use in the present fabric conditioning compositions exhibits a Wash Removal Value in the range from about 50% to about 98%, preferably from about 60% to about 95%. In another embodiment, the Wash Removal Value is from about 65% to about 90%, alternatively from about 70% to about 85%, alternatively from about 60% to about 70%, alternatively from about 70% to about 95%, and alternatively from about 70% to about 80%.

Table II lists the Hueing Efficiency Values and Wash Removal Values (as a percentage) for various preferred hueing dyes and non-preferred dyes of the present invention.

U.S. Pat. Nos. 3,157,663, 3,927,044, 4,113,721, 4,400,320, 4,601,725, 4,871,371, 5,766,268, 5,770,552, 5,770,557, 5,773,405 and 6,417,155 to Milliken Research Corporation describe colorants (dyes) containing polyoxyalkylenes soluble in polar solvents. These colorants can be used in the present invention when they exhibit a Hueing Efficiency of at least 20 and a Wash Removal Value in the range of from about 50% to about 98%.

TABLE II

Hueing Efficiency Values, residual coloration, and Wash Removal Values for various hueing dyes.

| Dye Name | Hueing Efficiency Value $DE^*_{eff}$ | Residual Coloration $DE^*_{res}$ | Wash Removal Value |
|---|---|---|---|
| Ethyl violet | 93.08 | 70.17 | 25 |
| Pergazol Violet BN-Z | 27.13 | 13.86 | 49 |
| Liquitint Violet CT | 32.48 | 10.38 | 68 |
| Liquitint Violet LS | 31.16 | 5.72 | 82 |
| Milliken Violet 28B | 21.65 | 15.75 | 87 |
| Nylosan Blue F-GBLN | 18.66 | 1.76 | 91 |
| Acid Brilliant Blue RAWL | 14.40 | 0.98 | 93 |
| Acid Violet 49 | 47.26 | 2.58 | 95 |
| Anazolene Sodium | 23.57 | 0.48 | 98 |
| Permalon Violet IRS | 21.31 | 0.45 | 98 |

Preferred Hueing Dyes

Preferred hueing dyes, are not limited to, but include the following:

| CI name | CI number | Structure |
|---|---|---|
| Acid Violet 43 (Anthraquinone) | 60730 | 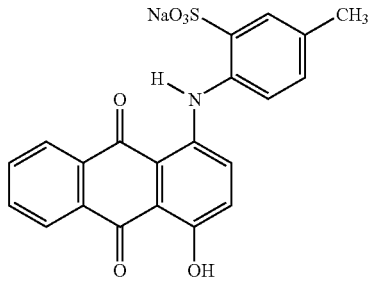 |
| Acid Violet 49 (Triphenylmethane) | 42640 | 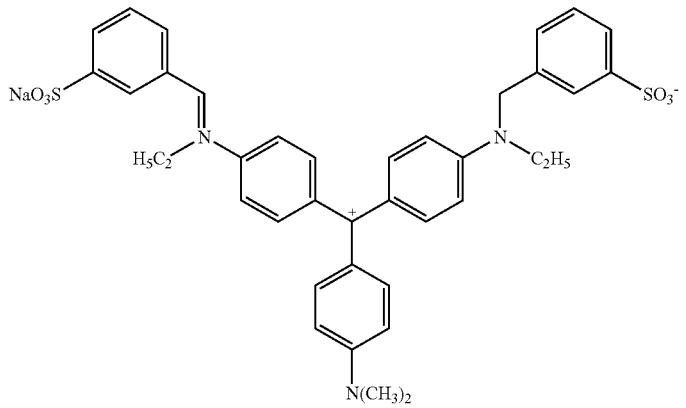 |

-continued

| CI name | CI number | Structure |
|---|---|---|
| Acid Blue 92 (Monoazo) | 13390 | 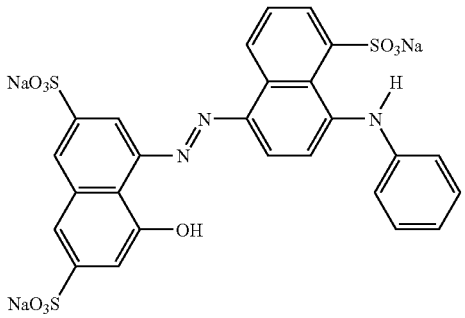 |
| Liquitint Violet CT | N/A | Proprietary (Milliken) |
| Liquitint Violet LS | N/A | Proprietary (Milliken) |
| Milliken Violet 28B | N/A | Proprietary (Milliken) |

Maximum Reflectance K/S Spectral Peak

Another aspect of the invention provides a hueing dye comprising a maximum reflectance K/S spectral peak having a lambda maximum ("Reflectance K/S Value") of from about 560 nm to about 620 nm, preferably from about 580 nm to about 600 nm. The Reflectance K/S Value is obtained from the Hunter Color QUEST spectrophotometer when the L*, a*, b* values are obtained for hueing efficiency.

Not wishing to be bound by theory, the hueing dyes having a Reflectance K/S Value as indicated exhibit a violet hue that optimally compensates for any yellowing of white fabrics, especially white cotton fabrics.

Fabric Staining

In another aspect of the invention, the hueing dye has little or no fabric staining. Not wishing to be bound by theory, fabric staining may occur from the normal use or misuse of the fabric conditioning composition. For example, fabric staining can occur when the fabric conditioning composition comprising a hueing dye comes into direct contact with wet fabrics, for example, after the spin cycle following the wash cycle. When such direct contact with a fabric conditioning composition comprising the hueing dye occurs, this leads to a high level of hueing dye in a relatively small area of the fabric. Such a high level of hueing dye in contact with the fabric may result in staining of the fabric.

Staining Potential: The staining potential of a fabric conditioning composition can be described as the "Staining Potential Score." The methodology for determining the Staining Potential Score is herein provided. The method comprises: (a) washing of an 100% white cotton Hanes® T-shirt in a liquid laundry detergent without bleach or bleach alternative, such as Liquid Tide® without bleach or bleach alternative, in accordance with the manufacture's instructions; (b) stopping the washing machine and taking the T-shirt out of the washer after the spin cycle is complete (wherein the spin cycle is one that immediately follows the wash cycle), applying by pipette directly onto the fabric about 3 ml of the fabric conditioning composition containing the hueing dye in question (wherein a plexiglass template with dosing holes can optionally be employed to guide the application of the composition on the wet fabric); (c) after a pre-designated amount of time for the fabric conditioning composition to be in direct contact with the fabric (up to ~2 minutes), the T-shirt is placed back into the washing machine, and the rinse cycle is allowed to proceed. Typical U.S. washing conditions, for example, would be a 90° F. wash cycle of approximately 12 minutes and a 60° F. rinse cycle of approximately 4 minutes and 2 minutes of spin, with a 17 gallon wash and rinse fill for 5.5 lbs of fabric. An example of a suitable washing machine is a Kenmore® 80 Series. The T-shirt is dried in a machine laundry dryer for 50 minutes on cotton/high (again, for 5.5 lbs of fabric) after the rinse cycle is complete. An example of a suitable dryer is by Kenmore®. After drying, the T-shirt is assessed for Staining Potential Score.

A fabric Staining Potential Score is calculated by measuring $DE^*_{stain}$, given by the following equation:

$$DE^*_{stain}=((L^*_c-L^*_s)^2+(a^*_c-a^*_s)^2+(b^*_c-b^*_s)^2)^{1/2}$$

wherein the subscripts "c" and "s" respectively refer to the "L*," "a*," and "b*" values measured_for: control conditions, i.e., the portion of the Fabric Sample that was not directly contacted by the fabric conditioning composition; and experimental conditions, i.e., the portion of the Fabric Sample that was directly contacted by the fabric conditioning composition. The L*, a*, b* value measurements are carried out using a Hunter Color QUEST spectrophotometer (Model #CQ45/0 SAV) as described in method for determing Hueing Efficiency Value. In one embodiment, the hueing dye suitable for use in the present fabric conditioning compositions exhibits a Staining Potential Score of not greater than about 10, preferably not greater than about 5.

The level of hueing dye used in the fabric conditioning composition can affect the staining potential of the composition. Hueing dyes are therefore normally evaluated for Staining Potential Score at a level that would be used in a fabric conditioning composition.

It will be understood that the hueing dyes tested by the methods of this invention are evaluated on an "as-received from the supplier" basis. Since the true dye content of an individual sample is often unknown exactly or difficult to determine, there is no attempt to correct dye levels to a 100% active dye basis. However, most dye samples are at least 40% active and some are as high as from about 90%–100% dye active.

Staining Index: A "Staining Index" can assess the effect of Stain-Reducing Agents on a particular hueing dye in a fabric conditioning composition. Based on the Staining Potential Test (herein described above), a Stain Index of a Stain-Reducing Agent added to a composition containing hueing dyes can be calculated based on the following equation:

$$\text{Staining Index}=100\times DE^*_{stain\text{-}dye\text{-}agent}/DE^*_{stain\text{-}dye}$$

wherein the $DE^*_{stain\text{-}dye}$ is the Staining Potential Score of the fabric conditioning composition in the absence of added Stain-Reducing Agents; and $DE^*_{stain\text{-}dye\text{-}agent}$ is the Staining Potential Score of the fabric conditioning composition in the presence of an added Staining-Reducing Agent. Thus if one the Stain-Reducing Agents completely eliminates the fabric stain, the Stain Index=0 and when the Stain-Reducing Agent does not reduce the fabric stain, the Stain Index=100. Thus, one aspect of the invention provides a fabric conditioning composition comprising a Stain-Reducing Agent having a Stain Index less than about 90, preferably less than 80, more preferably less than 70, more preferably less than 60, more preferably less than 50, more preferably less than 40, more preferably less than 30, more preferably less than 20, and more preferably less than 10.

Level of Hueing Dye

Higher levels of hueing dye in the composition generally give higher whitening performance results. However, too much dye may lead to fabric staining, for example in situations where the fabric conditioning composition is misused by the consumer. Fabric staining can occur when the fabric conditioning composition containing a high level of dye comes into direct contact with wet fabrics, for example, after the spin cycle following the wash cycle. Therefore, it is critical to find the right balance of good whitening performance by the hueing dye and at the same time not create a high level of potential fabric staining.

One aspect of the invention provides administering the hueing dyes in the present invention in an amount in the washing machine such that a concentration of from about 0.5 parts per billion (ppb) to about 5 part per million (ppm), preferably about 1 ppb to about 600 ppb, more preferably about 5 ppb to about 300 ppb, even more preferably about 10 ppb to about 100 ppb of hueing dye is achieved during the washing cycle, or preferably rinse cycle, of a 17 gallon automatic laundry washing machine.

Diluent for Hueing Dyes.

Some dye compositions can be difficult to handle in a manufacturing environment. In such cases, certain additives can be added as a diluent or processing aid to make the dye compositions more easily handled, transported, and measured. The selection of a diluent for a hueing dye can positively or negatively impact the dye's Hueing Efficiency and/or its Staining Potential. Solvents are useful as diluents for making dye stock solutions with dyes that are not highly miscible in water and may also provide good dispersibility. Suitable solvents of the present invention can be water-soluble or water-insoluble. Non-limiting examples include ethanol, propanol, isopropanol, n-propanol, n-butanol, t-butanol, propylene glycol, 1,3-propanediol, ethylene glycol, diethylene glycol, dipropylene glycol, 1,2,3-propanetriol, propylene carbonate, phenylethyl alcohol, 2-methyl 1,3-propanediol, hexylene glycol, glycerol, sorbitol, polyethylene glycols, 1,2-hexanediol, 1,2-pentanediol, 1,2-butanediol, 1,4 butanediol, 1,4-cyclohexanedimethanol, pinacol, 1,5-hexanediol, 1,6-hexanediol, 2,4-dimethyl-2,4-pentanediol, 2,2,4-trimethyl-1,3-pentanediol (and ethoxylates), 2-ethyl-1,3-hexanediol, phenoxyethanol (and ethoxylates), glycol ethers such as butyl carbitol and dipropylene glycol n-butyl ether, ester solvents such as dimethyl esters of adipic, glutaric, and succinic acids, hydrocarbons such as decane and dodecane, or mixtures thereof.

Surfactant solutions can also be used as diluents for hueing dyes. Ethoxylated monoalkyl quaternary surfactants are particularly good solvents for dissolving brightener in water and could also help effectively deliver hueing dyes during the making process. Solutoins of Ethoquad C/25 (cocomethyl ethoxylated [15] ammonium chloride), Ethoquad HT/25 and Ethoquad O/12 from Akzo Nobel are additional ethoxylated quarternary amines that could be used as effective diluents for hueing dyes. Additional suitable surfactants in the present invention can be nonionic, cationic, zwitterionic, or ampholytic, or mixtures thereof.

The diluent used to adjust the stock dye solution to deliver a consistent level of dye can also affect the performance of the fabric softening composition. Depending on the miscibility of the hueing dye with water, the stock dye solutions may use diluents other than water. In such cases where a diluent other than water is used to make a stock dye solution, differences in hueing efficiencies, whitening benefit, and staining potential may be observed.

Stain-Reducing Agents

Surfactants as Stain-Reducing Agents

Some surfactants can be used in the fabric softening composition to reduce fabric staining. It has surprisingly been found that ethoxylated monoalkyl quaternary surfactants are particularly effective at reducing fabric staining when incorporated in the composition with hueing dyes and are also particularly good solvents for dissolving brightener (Tinopal CBS-X) in water. Particularly effective is Ethoquad® C/25 (cocoalkylmethyl (polyoxyethylene [15] ammonium chloride) from Akzo Nobel. The nominal structure is shown below.

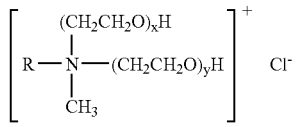

where R=Alkyl groups from coconut oil, and x+y=15

Ethoquad HT/25 and Ethoquad O/12 are additional ethoxylated quarternary amines that could also be used. Additional suitable surfactants in the present invention can be cationic, nonionic, zwitterionic, or ampholytic (amphoteric), or mixtures thereof.

Cationic Surfactants

Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042, 4,239,660, 4,260,529 and U.S. Pat. No. 6,022,844; and e) amino surfactants as discussed in U.S. Pat. No. 6,221,825 and WO 00/47708, specifically amido propyldimethyl amine (APA).

Non-limiting examples of quaternary alkyl-polyoxyethylene amine based surfactants are shown below:

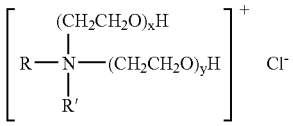

in which R=C8–24 alkyl groups; R'=$CH_3$, H, or other alkyls, x>0, y>0.

such as: cocoalkylmethyl[polyoxyethylene (15) ammonium chloride, or in above structure R=cocoalkyl, R'=$CH_3$ and x+y=15; octadecylmethyl[polyoxyethylene (15) ammonium chloride, or in above structure R=C18 alkyl, R'=$CH_3$ and x+y=15; cocoalkylmethylbis(2-hydroxyethyl) ammonium chloride, or in above structure R=coco alkyl, R'=$CH_3$ and x=y=1; oleylmethylbis(2-hydroxyethyl) ammonium chloride, or in above structure R=Alkyl from oleic acid, R'=$CH_3$ and x=y=1; benzylbis(2-hydroxyethyl) cocoalkyl ammonium chloride, or in above structure R=coco alkyl, R'=$CH_2C_6H_5$ and x=y=1;

More examples of quaternary alkyl-polyoxyethylene amine based surfactants are shown below:

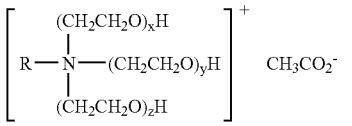

such as: tris(2-hydroxyethyl)tallowalkyl ammonium acetate, or in above structure R=alkyl from tallow and x=y=z=1;

Non-limiting examples of non-quaternary alkyl-polyoxyethylene amine based surfactants are shown below:

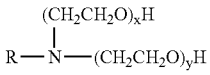

such as: polyoxyethylene (15) cocoalkylamines, or in above structure R=coco alkyl and x+y=15; polyoxyethylene (15) tallowalkylamines, or in above structure R=tallow alkyl and x+y=15; bis(2-hydroxyethyl) cocoalkylamines, or in above structure R=cocoalkyl and x=y=1; bis(2-hydroxyethyl) tallowalkylamines, or in above structure R=tallow alkyl and x=y=1;

Nonionic Surfactants

Suitable nonionic surfactants useful herein can comprise any of the conventional nonionic surfactant types typically used in liquid and/or solid detergent products. These include alkoxylated fatty alcohols and amine oxide surfactants.

Suitable nonionic surfactants for use herein include the alcohol alkoxylate nonionic surfactants. Alcohol alkoxylates are materials which correspond to the general formula: $R^1(C_mH_{2m}O)_nOH$ wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. In one embodiment, the alkoxylated fatty alcohols will also be ethoxylated materials that contain from about 2 to 12 ethylene oxide moieties per molecule, more preferably from about 3 to 10 ethylene oxide moieties per molecule.

The alkoxylated fatty alcohol materials useful in compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradenames Neodol and Dobanol by the Shell Chemical Company.

Another suitable type of nonionic surfactant useful herein comprises the amine oxide surfactants. Amine oxides are materials which are often referred to in the art as "semi-polar" nonionics. Amine oxides have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, preferably from 10 to 16 carbon atoms, and is more preferably $C_{12}$–$C_{16}$ primary alkyl. R' is a short-chain moiety, preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Non-limiting examples of nonionic surfactants include: a) $C_{12}$–$C_{18}$ alkyl ethoxylates, such as, NEODOL® nonionic surfactants from Shell; b) $C_6$–$C_{12}$ alkyl phenol alkoxylates wherein the alkoxylate units are a mixture of ethyleneoxy and propyleneoxy units; c) $C_{12}$–$C_{18}$ alcohol and $C_6$–$C_{12}$ alkyl phenol condensates with ethylene oxide/propylene oxide block polymers such as Pluronic® from BASF; d) $C_{14}$–$C_{22}$ mid-chain branched alcohols, BA, as discussed in U.S. Pat. No. 6,150,322; e) $C_{14}$–$C_{22}$ mid-chain branched alkyl alkoxylates, $BAE_x$, wherein x 1–30, as discussed in U.S. Pat. Nos. 6,153,577, 6,020,303 and 6,093,856; f) Alkylpolysaccharides as discussed in U.S. Pat. No. 4,565,647 Llenado, issued Jan. 26, 1986; specifically alkylpolyglycosides as discussed in U.S. Pat. Nos. 4,483,780 and 4,483,779; g) Polyhydroxy fatty acid amides as discussed in U.S. Pat. No. 5,332,528, WO 92/06162, WO 93/19146, WO 93/19038, and WO 94/09099; and h) ether capped poly (oxyalkylated) alcohol surfactants as discussed in U.S. Pat. No. 6,482,994 and WO 01/42408.

Non-limiting examples of nonionic surfactants include Pluronic® L-81, Pluronic® L-35 from BASF. Generally, Plurafac® LF types are low-foaming non-ionic surfactants that consist of alkoxylated Fatty alcohols, and predominantly contain unbranched higher alkene oxides alongside ethylene oxide. Further information about the Plurafac® LF types can be obtained from BASF's technical information brochure dated February 1995.

Other preferred nonionic surfactants include Planteran 2000, Laureth-7 and Lonza PGE-10-1-L, Neodol 23-9, Neodol 91-8, and Neodol 25-3, or mixtures thereof.

Zwitterionic, Ampholytic or Amphoteric Surfactants

Non-limiting examples of ampholytic surfactants include: betaine, including alkyl dimethyl betaine and cocodimethyl amidopropyl betaine, $C_8$ to $C_{18}$ (preferably $C_{12}$ to $C_{18}$)

amine oxides and sulfo and hydroxy betaines, such as N-alkyl-N,N-dimethylammino-1-propane sulfonate where the alkyl group can be $C_8$ to $C_{18}$, preferably $C_{10}$ to $C_{14}$; aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, line 38 through column 22, line 48, for examples of zwitterionic surfactants The stain reduction effect of Ethoquad® C/25 is listed in the following table (Table III).

TABLE III

Fabric Stain Reduction by Ethoquad ® C/25

| Level of Ethoquad ® C/25 | Staining Potential Score ($DE^*_{stain}$) |
|---|---|
| 0.26% | 4.22 |
| 0.52% | 3.14 |
| 1.00% | 2.31 |

TABLE III-continued

Fabric Stain Reduction by Ethoquad ® C/25

| Level of Ethoquad ® C/25 | Staining Potential Score ($DE^*_{stain}$) |
|---|---|
| 1.50% | 1.91 |
| 2.00% | 1.82 |

*Staining Potential Score measured of a fabric conditioning composition containing 0.015% Liquitint Violet LS and 0.003% Liquitint Voilet CT.

* Staining Potential Score measured of a fabric conditioning composition containing 0.015% Liquitint Violet LS and 0.003% Liquitint Violet CT.

Soluble Polymeric Materials for Hueing Dyes to Reduce Fabric Staining

The present fabric conditioning compositions may further comprise soluble polymers to be used together with hueing dyes to reduce fabric staining. It was surprisingly discovered that some preferred particulate dispersing polymers can effectively reduce fabric staining when the fabric conditioning composition comprising a hueing dye comes into direct contact with fabrics.

Non-limiting examples of dispersant polymers include ethoxylate amine polymers such as ethoxylated (20) polyethyleneimine (PEI600-E20) and ethoxylated (15) tetraethylene pentaimine (PEI189-E15).

Representative structures of PEI600-E20 and PEI189-E15 are shown below:

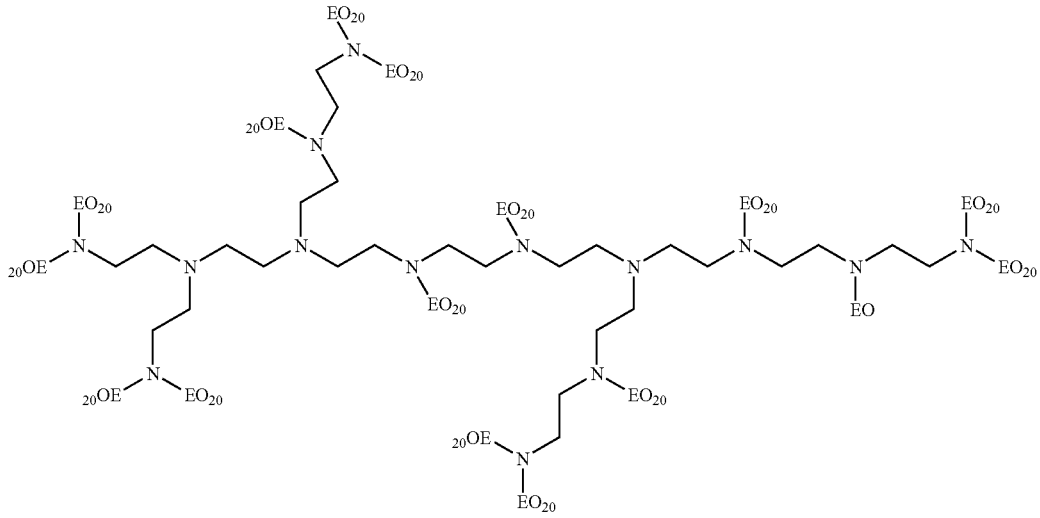

PEI600-E20 where $EO_{20}$ = —$(CH_2CH_2O)_{20}H$

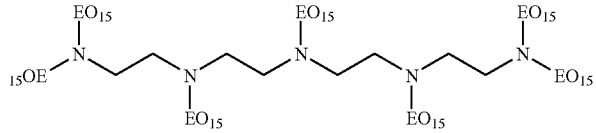

PEI189-E15 where $EO_{15}$ = —$(CH_2CH_2O)_{15}H$

More non-limiting examples of soluble polymers include ethoxylated block copolymer synthesized from dimethylterephthalate and 1,2-propylene glycol such as shown as representative structure as below:

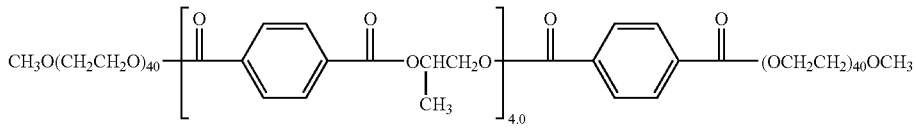

Another non-limiting examples of soluble polymers includes copolymers containing vinypyrrolidone such as Ganex® P 904.

Particles to Reduce Fabric Staining and Product Color

The present fabric conditioning compositions may further comprise dispersed organic or inorganic particles to be used together with hueing dyes to reduce fabric staining. It was surprisingly discovered that some preferred dispersed particles can effectively reduce fabric staining when the fabric conditioning composition comprising a hueing dye comes into direct contact with fabrics. Further, some preferred dispersed particles can act to opacify the product to reduce the product color. This benefit is needed when the product color is more intense than ideal due to use of hueing dyes in the composition.

Non-limiting examples of dispersed organic particles include nanolatexes based on co-polymers containing methyl methacrylates, co-polymers containing vinypyrrolidone and styrene such as Polectron® 430 from ISP.

Non-limiting examples of dispersed inorganic particles include natural clays such as Benonite and Montmorillonite, synthetic clays such as Laponite from SCP.

More non-limiting examples of dispersed inorganic particles include Titanium Oxides ($TiO_2$). It is discovered that nano-sized $TiO_2$ when incorporated in the fabric are composition containing hueing dyes can reduce fabric staining, at the same time, $TiO_2$ can effectively reduce the product color.

Table IV below lists the Staining Index of selected Staining-Reducing Agents including surfactants, soluble polymers and dispersed particles.

TABLE IV

Fabric Stain Reduction by Surfactants, Soluble Dispersant Polymers and Dispersed Particles

| Stain-Reducing Agents | Staining Index* |
|---|---|
| PEI600-E20 | 51 |
| PEI189-E15 | 55 |
| Pluronic ® L-81 | 57 |
| Polectron ® 430 | 60 |
| Ganex ® P-904 | 60 |
| Nanolatex containing polymethylmethacrylate | 63 |
| Pluronic ® L-35 | 66 |
| Ethoxylated block copolymer synthesized from dimethylterephthalate and 1,2-propylene glycol | 75 |
| C16–18 Amine Oxide | 76 |
| Nanosized $TiO_2$ | 90 |

*Staining Index measured for agents at 2% level in the fabric conditioning composition containing 0.015% Liquitint Violet LS and 0.003% Liquitint Violet CT.

Fabric Care Actives

The present fabric conditioning compositions comprise a fabric care active. The fabric care active of the present invention is used herein in the broadest sense to include any compound that provides a benefit to fabric. In one embodiment, the fabric care active is selected from any compound that provides a fabric softening or conditioning benefit. In one embodiment, the fabric care active is a fabric softening active.

Typical minimum levels of incorporation of the fabric care active in the present compositions are at least about 1%, alternatively at least about 2%, alternatively at least about 5%, alternatively at least about 10%, alternatively at least about 12%, by weight of the composition; and the typical maximum levels of incorporation of the fabric softening active in the present compositions are less than about 90%, alternatively less than about 40%, alternatively less than about 30%, and alternatively than about 20%, by weight of the composition.

Diester Quaternary Ammonium (DEQA) Compounds

In one embodiment, the fabric softening active comprises a DEQA compound. The DEQA compounds encompass a description of diamido fabric softener actives as well as fabric softener actives with mixed amido and ester linkages.

A first type of DEQA suitable as a fabric softening active in the present compositions includes compounds of the formula:

$$\{R_{4-m}—N^+—[(CH_2)_n—Y—R^1]_m\}X^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, poly ($C_{2-3}$ alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C(O)—NR— and it is acceptable for each Y to be the same or different; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group; it is acceptable for $R^1$ to be unsaturated or saturated and branched or linear and preferably it is linear; it is acceptable for each $R^1$ to be the same or different and preferably these are the same; and $X^-$ can be any softener-compatible anion, preferably, chloride, bromide, methylsulfate, ethylsulfate, sulfate, phosphate, and nitrate, more preferably chloride or methyl sulfate.

Other suitable fabric softening actives are described in U.S. Pat. Pub. 2004/0204337 A1, published Oct. 14, 2004, at paragraphs 74–79.

In another embodiment, the fabric softening active is chosen from at least one of the following: ditallowoyloxyethyl dimethyl ammonium chloride, dihydrogenated-tallowoyloxyethyl dimethyl ammonium chloride, dicanolaoyloxyethyl dimethyl ammonium chloride, ditallow dimethyl ammonium chloride, tritallow methyl ammonium chloride, methyl bis(tallow amidoethyl)2-hydroxyethyl ammonium methyl sulfate, methyl bis(hydrogenated tallow amidoethyl)-2-hydroxyethyl ammonim methyl sulfate, methyl bis (oleyl amidoethyl)-2-hydroxyethyl ammonium methyl sulfate, ditallowoyloxyethyl dimethyl ammonium methyl sulfate, dihydrogenated-tallowoyloxyethyl dimethyl ammonium chloride, dicanola-oyloxyethyl dimethyl ammonium chloride, N-tallowoyloxyethyl-N-tallowoylaminopropyl methyl amine, 1,2-bis(hardened tallowoyloxy)-3-trimethylammonium propane chloride, and mixtures thereof.

Cationic Starch

One aspect of the invention provides a fabric softening composition comprising a cationic starch as a fabric softening active. In one embodiment, the fabric conditioning compositions of the present invention generally comprise cationic starch at a level of from about 0.1% to about 7%, alternatively from about 0.1% to about 5%, alternatively from about 0.3% to about 3%, and alternatively from about 0.5% to about 2.0%, by weight of the composition. Cationic starch as a fabric softening active is described in U.S. Pat. Pub. 2004/0204337 A1, published Oct. 14, 2004, to Corona et al., at paragraphs 16–32. Suitable cationic starches for use in the present compositions are commercially-available from Cerestar under the trade name C*BOND® and from National Starch and Chemical Company under the trade name CATO® 2A.

Silicone

In one embodiment, the fabric softening composition comprises a silicone. Suitable levels of silicone may comprise from about 0.1% to about 50%, alternatively from about 1% to about 40%, alternatively from about 2% to about 30%, alternatively from about 3% to about 20% by weight of the composition. In one embodiment, the silicone is emulsified, preferably as a high internal phase emulsion (HIPE). Non limiting examples of silicones include those described in U.S. Pat. Pub. No. 2002/0077265 A1, to Buzzacarini et al., published Jun. 20, 2002 at paragraphs 51–57. Yet other non limiting examples includes those described in U.S. Provisional Pat Appl. No. 60/653,897 filed Mar. 11, 2005 (P&G Case 9910P) and subsequent U.S. provisional and non-provisional patent applications thereof.

One example of a silicone is a polydialkylsilicone, alternatively a polydimethyl silicone (polydimethyl siloxane or "PDMS"), or a derivative thereof. In another embodiment, the silicone is chosen from an aminofunctional silicone, alkyloxylated silicone, ethoxylated silicone, propoxylated silicone, ethoxylated/propoxylated silicone, quaternary silicone, or a mixture thereof.

One aspect of the present invention provides a cationic or amino functionalized silicones such as those described in U.S. patent application Ser. No. 10/978,942, filed Nov. 1, 2004 (P&G Case 9404); and U.S. Pat. Publ. No. 2005/0026793 A1, Feb. 3, 2005, at paragraphs 137–162.

Sucrose Ester-Based Fabric Care Materials

In one embodiment, the compositions of the present invention may comprise a sucrose ester-based fabric care material is a FSA. A sucrose ester may be composed of a sucrose moiety having one or more of its hydroxyl groups esterified.

Sucrose is a disaccharide having the following formula:

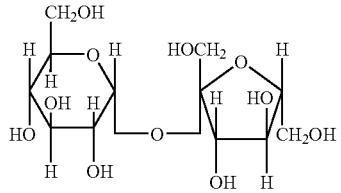

Alternatively, the sucrose molecule can be represented by the formula: $M(OH)_8$, wherein M is the disaccharide backbone and there are total of 8 hydroxyl groups in the molecule.

Thus, sucrose ester can be represented by the following formula:

$$M(OH)_{8-x}(OC(O)R^1)_x$$

wherein x of the hydroxyl groups are esterified and (8−x) hydroxyl groups remain unchanged; x is an integer selected from 1 to 8, or from 2 to 8, or from 3 to 8, or from 4 to 8; and $R^1$ mioeties are independently selected from C1–C22 alkyl or C1–C30 alkoxy, linear or branched, cyclic or acyclic, saturated or unsaturated, substituted or unsubstituted.

In one embodiment, the $R^1$ moieties comprise linear alkyl or alkoxy moieties having independently selected and varying chain length. For example, $R^1$ may comprise a mixture of linear alkyl or alkoxy moieties wherein greater than about 20% of the linear chains are C18, or greater than about 50% of the linear chains are C18, or greater than about 80% of the linear chains are C18.

In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the sucrose esters suitable for use herein ranges from about 1 to about 150, or from about 2 to about 100, or from about 5 to about 85. The $R^1$ moieties may be hydrogenated to reduce the degree of unsaturation.

In a further embodiment, the unsaturated $R^1$ moieties may comprise a mixture of "cis" and "trans" forms about the unsaturated sites. The "cis"/"trans" ratios may range from about 1:1 to about 50:1, or from about 2:1 to about 40:1, or from about 3:1 to about 30:1, or from about 4:1 to about 20:1.

In another embodiment, the composition comprises an olyhydroxy material or sugar derivative. Polyhydroxy amide structures as disclosed in U.S. Pat. No. 5,534,197 by Scheibel et al. and U.S. Pat. No. 5,512,699 by Connor et al.; Pentaerythritol compounds and derivatives as disclosed in U.S. Pat. No. 6,294,516; cyclic polyols and/or reduced saccharides as disclosed in U.S. Pat. No. 6,410,501.

Clays

In one embodiment of the invention, the fabric conditioning composition may comprise a clay as a fabric care active. Preferred clays include those materials classified geologically smectites and are described in U.S. Pat. Appl. Publ. 20030216274 A1, to Valerio Del Duca, et al., published Nov. 20, 2003, paragraphs 107–120.

Other suitable clays are described U.S. Pat. Nos. 3,862,058; 3,948,790; 3,954,632; and 4,062,647.

Softening Oils

Another class of fabric care actives is softening oils, which include but are not limited to, vegetable oils, hydrocarbon based oils (natural and synthetic petroleum lubricants, preferably polyolefins, isoparaffins, and cyclic paraffins), triolein, fatty esters, fatty alcohols, fatty acids, fatty amines, and fatter ester amines. If used by themselves, oils usually require a cationic deposition aid such as a cationic polymer or a di or mono alkyl quaternary ammonium salt. Fatty acids include their salts such as sodium, potassium, calcium and magnesium. Oils can be combined with other softening agents such as traditional quaternary actives, clays, and silicones.

Other Fabric Softening Actives

Examples of other softening actives can be found in U.S. 2004-0204337 A1; U.S. Pat. Nos. 5,877,145; 5,545,340; 5,545,350; 6,559,117; 6,492,322; 4,439,335; 4,399,045; 6,323,172; 6,335,315; 6,369,025; 6,686,331; 6,608,024; and U.S. 2003-0139312A1.

Brighteners

One aspect of the invention provides for a fabric conditioning composition comprising a brightener. "Brightener" (also called "optical brightener") is used herein the broadest sense to include any compound that exhibits fluorescence. This includes all compounds that absorb UV light and reemit as "blue" visible light. Suitable brighteners include fluorescent whitening agents and are more fully described in the following: (1) Ullman's Encyclopedia of Industrial Chemistry, Fifth Edition, Vol. A18, Pages 153 to 176; (2) Kirk-Othmer Encyclopedia of Chemical Technology, Volume 11, Fourth Edition; and (3) Fluorescent Whitening Agents, Guest Editors R. Anliker and G. Muller, Georg Thieme Publishers Stuttgart (1975). Preferred brighteners are also low in color or colorless and do not absorb materially in the visible part of the spectrum. Preferred brighteners are also light fast, meaning they do not degrade substantially in sunlight. Brighteners suitable for use in this invention absorb light in the ultraviolet portion of the spectrum between about 275 nm and about 400 nm and emit light in the violet to violet-blue range of the spectrum from about 400 nm to about 500 nm. Preferably, the brighteners will contain an uninterrupted chain of conjugated double bonds. Brighteners are typically, but not limited to, derivatives of stilbene or 4,4'-diaminostilbene, biphenyl, five-membered heterocycles such as triazoles, oxazoles, imidiazoles, etc., or six-membered heterocycles (coumarins, naphthalamide, s-triazine, etc.). Cationic, anionic, nonionic, amphoteric and zwitterionic brighteners can be used. Cationic brighteners are preferred since these can compete effectively with the cationic fabric softener actives to partition to the surface of the fabric. Both cationic and nonionic brighteners are especially preferred so they do not interact in a negative manner with other ingredients in the cationic fabric conditioning composition. For example, anionic brighteners, while still very usable and can provide a good whitening benefit, can interact with a cationic component in the fabric conditioning composition such as cationically substituted starch or other cationic polymers. The effect can be that the anionic brightener can negate some or all of the softening effect provided by the cationic starch or other cationic polymers.

Non-limiting brighteners, which also can provide a dye transfer inhibition action, useful in the present invention are those having the general structural formula:

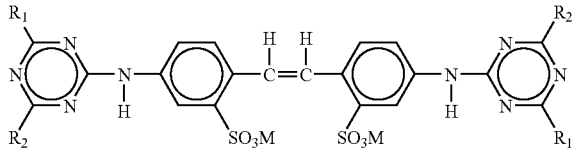

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba Specialty Chemicals Corporation.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba Specialty Chemicals Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by Ciba Specialty Chemicals Corporation.

Brighteners should have some water solubility for easy incorporation into the fabric conditioning composition. For example the water solubility (deionized water) of the brightener should be at least about 0.5 weight percent at 25° C., preferably at least about 2 weight percent. Fluorescent whitening agents, generally due to their low water solubility, are difficult to incorporate into liquid fabric conditioning compositions. Often it is advantageous to post-add brighteners to a finished base product. One convenient way to do this is to make a brighteners premix.

It has surprisingly been found that ethoxylated monoalkyl quaternary surfactants are particularly good solvents for dissolving anionic brighteners such as Tinopal CBS-X in water. Recall that these surfactants are also surprisingly effective at reducing fabric staining when incorporated into a fabric conditioning composition with hueing dyes. Particularly effective is Ethoquad C/25 (cocomethyl ethoxylated [15] ammonium chloride) from Akzo Nobel. Its nominal structure was shown earlier (in section: entitled "Surfactants as Stain-Reducing Agents").

Thus one aspect of the invention provides a method of making a fabric conditioning composition comprising the step: adding a first composition comprising: (a) anionic brightener (such as Tinopal CBS-X) and (b) an ethoxylated monoalkyl quaternary compound (i.e., a "brightener premix") to a second composition comprising fabric care active.

Alternatively, brighteners can be added to a hot water seat or hot oil seat in the making of the fabric conditioning composition, which those skilled in the art are familiar.

Brighteners are used in fabric conditioning compositions of the present invention in the range of about 0.01% to about 5% by weight.

Level of Fluorescent Whitening Agent

One aspect of the invention provides administering an BRIGHTENER in the present invention in an amount in the washing machine such that a concentration is from about 0.05 parts per million (ppm) to about 25 ppm, preferably about 0.1 ppm to about 20 ppm, more preferably about 0.5 ppm to about 15 ppm, even more preferably about 1 ppm to about 10 ppm of brightener is achieved during the washing cycle, or preferably rinse cycle, of an automatic laundry washing machine.

Preferred Brighteners:

Some preferred, but non-limiting, brighteners are shown below:

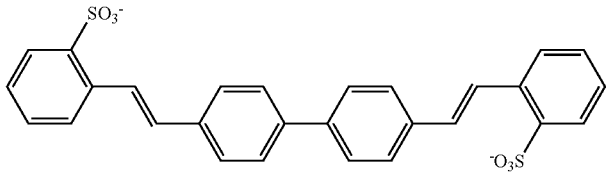

Tinopal CBS-X (Ciba)
Disodium 4,4′-bis-(2-sulfostyryl)biphenyl

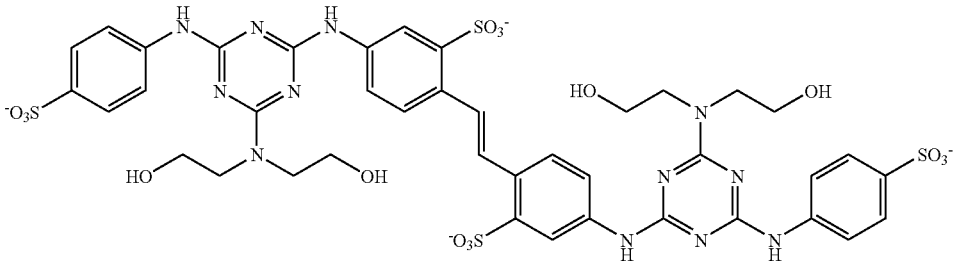

Tinopal DCS (Ciba)
Benzenesulfonic acid, 2,2′-(1,2-ethenediyl)bis[5-[4-[(2-hydroxyethyl)methylamino]-6-(phenylamino)-1,3,5-triazin-2-y]amino]-, disodium salt

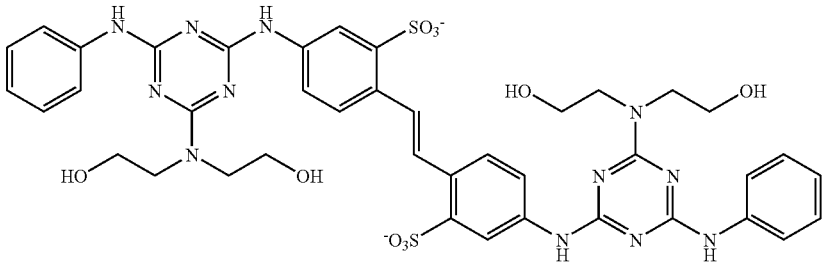

Tinopal UNPA-GX (Ciba)
Disodium 4,4′-bis{[4-anilino-6-[bis(2-hydroxyethyl)amino-s-triazin-2-yl]-amino}-2,2′-stilbenedisulfonate

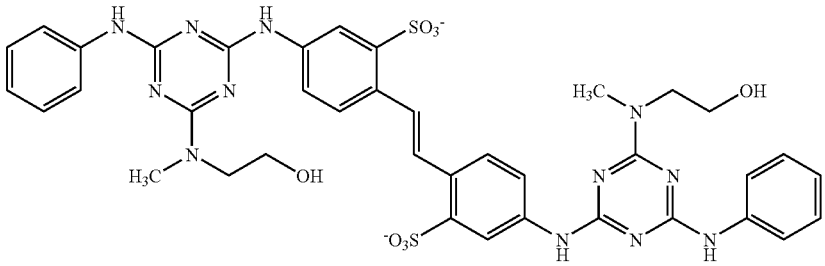

Tinopal 5BM-GX (Ciba)
Disodium 4,4′-bis[(4-anilino-6-(N-2-hydroxyethyl-N-methylamino)-s-triazine-2-yl)amino]2,2′-stilbenedisulfonate -continued

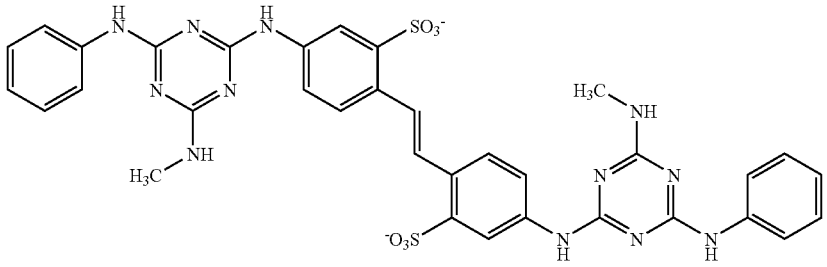

Blankophor HRS (Bayer)
Disodium 4,4′-bis{[4-anilino-6-methylamino-s-triazin-2-yl]-amino}2,2′-stilbenedisulfonate.

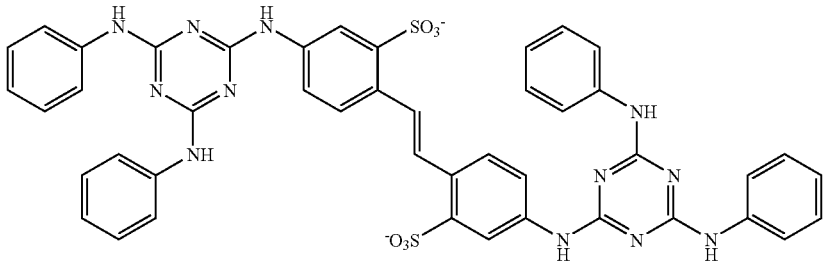

Tinopal TAS (Ciba)
Disodium 4,4″-bis[4,6-di-anilino-s-triazin-2-yl]-2,2′-stilbenedisulfonate

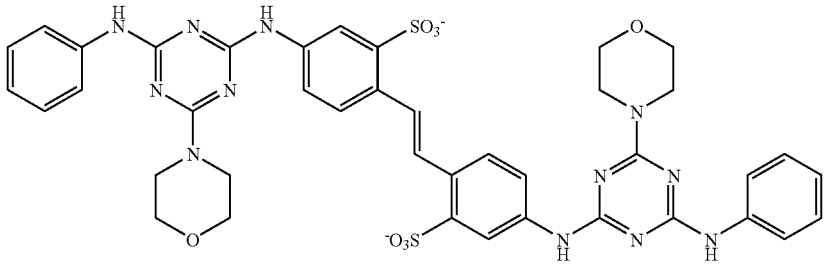

Tinopal AMS-GX (Ciba)
Disodium 4,4′-bis{[4-anilino-6-morpholino-s-triazin-2-yl}-amino}-2,2′-stilbenedisulfonate The Tinopal CBS-X brightener is especially preferred due to its good water solubility of about 2.5 weight percent at 25° C., and the fact that it maintains its chemical stability in the acidic product matrix of biodegradable fabric conditioning compositions (e.g., pH is from about 3 to about 4) better than some other brighteners.

Cationic Polymer-Anionic Brightener Complex.

One aspect of the invention provides a method of adding a cationic polymer, preferably a cationic polysaccharide, to an anionic brightener to form a cationic polymer-anionic brightener complex.

Another aspect of the invention provides a composition comprising a cationic polymer-anionic brightener complex. In one embodiment, the composition is a cationic polysaccharide-anionic brightener complex. In another embodiment, the composition is a cationic starch-anionic brightener complex. In yet another embodiment, the cationic polymer-anionic brightener complex has about a neutral charge. One suitable way of estimating whether the complex has a neutral charge is by using equal equivalent molar weights of anionic brightener and cationic polymer in making the complex.

Yet another aspect of the invention provides method of making a composition comprising the step of adding a cationic polymer-anionic brightener complex to fabric care active, preferably fabric softening active.

As previously disclosed, anionic brighteners can interact with cationic fabric care actives, especially cationic polysaccharide polymers (e.g., cationic starch), in fabric conditioning compositions to reduce softness performance and/or other benefits. One way to overcome the negative effects of anionic brighteners is to form a complex with the anionic brightener using a cationic polymer (as previous described under "Cationic Polymers" and/or a highly charged cationic starch as previously described under "Cationic Starch Compounds") before adding the brightener to the fabric conditioning formulation. For example, 6.2 g of Tinopal CBS-X is interacted with 3.6 g of Magnafloc 370 (a highly charged cationic polymer from Ciba; CTFA Polyquaternium-6) in 8.0 g Ethoquad C/25 solvent and 82.2 g of water. The complex is then added to a composition of fabric softener actives containing in one ebodiment a cationic starch (which is part of the softener active system) along with biodegradable quaternary actives to form the fabric care active component of the fabric conditioning composition. The fabric conditioning composition shows excellent softness and no interaction of the anionic brightener with the cationic starch in the fabric conditioning composition (i.e., no decrease in softness performance is caused by the anionic brightener).

The amount of cationic polymer needed depends on the % N (nitrogen) content of the cationic polymer. Enough cationic polymer is added to sufficiently complex all or virtually all of the anionic charge on the optical brightener to prevent any free anionic charge interacting with the cationic starch softening agent once added to the fabric conditioning composition.

Adjunct Ingredients

The composition of the present invention may comprise an optional ingredient. Some optional ingredients include, but are not limited to, builders, surfactants, nonionic surfactant, non-aqueous solvent, enzymes, bleach activators, bleach catalysts, bleach boosters, bleaches, stabilizers (such as propylene glycol, boric acid and/or borax), suds suppressors, soil suspending agents, soil release agents, other fabric conditioning benefit agents, pH adjusting agents, chelating agents, smectite clays, solvents, fatty acid, hydrotropes and phase stabilizers, structuring agents, dye transfer inhibiting agents, alkalinity sources, antibacterial agents, colorants, perfumes, pro-perfumes, finishing aids, lime soap dispersants, odor control agents, odor neutralizers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters and mixtures thereof.

In one embodiment, the composition of the present invention comprises from about 0% to about 2%, alternatively about 0.1% to about 1%, of any one or more aforementioned adjunct ingredients. In another embodiment, the fabric conditioning composition is free or essentially free of any one or more the aforementioned adjunct ingredients.

Composition Forms

In one embodiment, the fabric conditioning composition is a wash added composition (i.e., added during the wash cycle of an automatic laundry machine). In another embodiment, the fabric conditioning composition is a rinse added composition (i.e., added during the rinse cycle of an automatic laundry machine). In another embodiment, the fabric conditioning composition is administered as a unit dose. In another embodiment, the fabric conditioning composition is concentrated. In another embodiment, the fabric conditioning composition is dilute.

In one embodiment, the fabric conditioning composition of the present invention is essentially free of detersive detergent. In another embodiment, the fabric conditioning composition comprises less than 5%, alternatively less than 4%, alternatively less than 3%, alternatively less than 2%, alternatively less than 1%, alternatively about 0%, of a detersive detergent by weight of the fabric conditioning composition.

Methods

The present inventions provides for a method softening and/or whitening fabric comprising the step of dosing a composition of the present invention to an automatic laundry washing machine or hand washing laundry basin. In one embodiment, a kit is provided comprising a composition of the present invention and optionally comprising instructions instructing the user to add the composition to the washing machine or hand washing laundry basin.

EXAMPLES

The following are non-limiting examples of the fabric conditioning compositions of the present invention.

| | EXAMPLES | | | | | | |
|---|---|---|---|---|---|---|---|
| INGREDIENTS | I | II | III | IV | V | VI | VII |
| Fabric Softening Active[a] | 14.00% | 13.70% | 13.70% | 13.70% | 13.70% | 4.67% | 4.67% |
| Ethanol | 2.28% | 2.14% | 2.14% | 2.14% | 2.14% | 0.76% | 0.76% |
| Cationic Starch[b] | 2.00% | 2.17% | 2.17% | 2.17% | 2.17% | 0.67% | 0.67% |
| Perfume | 1.58% | 1.45% | 1.45% | 1.45% | 1.45% | 0.50% | 0.50% |
| Phase Stabilizing Polymer[c] | 0.25% | 0.21% | 0.21% | 0.21% | 0.21% | — | — |
| Calcium Chloride | 0.300% | 0.147% | 0.147% | 0.147% | 0.147% | — | — |
| DTPA[d] | 0.005% | 0.007% | 0.007% | 0.007% | 0.007% | 0.003% | 0.003% |
| Preservative[e] | 7.5 ppm | 5 ppm | 5 ppm | 5 ppm | 5 ppm | 7.5 ppm | 7.5 ppm |
| Antifoam[f] | 0.011% | 0.015% | 0.015% | 0.015% | 0.015% | 0.011% | 0.011% |
| Acid Violet #49 | 30 ppm | | | | | — | — |
| Liquitint Violet CT[g] | | 30 ppm | 30 ppm | | | 30 ppm | 60 ppm |
| Liquitint Violet LS[h] | — | 150 ppm | 150 ppm | | | 60 ppm | |
| Milliken Violet 28B[i] | | | | 90 ppm | 90 ppm | | |
| Tinopal CBS-X[j] | 0.4 | 0.2 | 0.2 | 0.2 | 0.2 | 0.13 | 0.13 |
| Ethoquad C/25[k] | 0.52 | 0.26 | 1.04 | 0.26 | 1.04 | 1.04 | 0.52 |
| Ammonium Chloride | 0.1% | 0.1% | 0.1% | 0.1% | 0.1% | — | — |

-continued

| INGREDIENTS | EXAMPLES I | II | III | IV | V | VI | VII |
|---|---|---|---|---|---|---|---|
| Hydrochloric Acid | 0.012% | 0.012% | 0.012% | 0.012% | 0.012% | 0.0004% | 0.0004% |
| Deionized Water | Balance | Balance | Balance | Balance | Balance | Balance | Balance |

[a]N,N-di(tallowoyloxyethyl)-N,N-dimethylammonium chloride.
[b]Cationic starch based on common maize starch or potato starch, containing 25% to 95% amylose and a degree of substitution of from 0.02 to 0.09, and having a viscosity measured as Water Fluidity having a value from 50 to 84.
[c]Copolymer of ethylene oxide and terephthalate having the formula described in U.S. Pat. No. 5,574,179 at col. 15, lines 1–5, wherein each X is methyl, each n is 40, u is 4, each $R^1$ is essentially 1,4-phenylene moieties, each $R^2$ is essentially ethylene, 1,2-propylene moieties, or mixtures thereof.
[d]Diethylenetriaminepentaacetic acid.
[e]KATHON ® CG available from Rohm and Haas Co.
[f]Silicone antifoam agent available from Dow Corning Corp. under the trade name DC2310.
[g]Available from Milliken Chemical Company (nominally 100%).
[h]Available from Milliken Chemical Company (nominally 100%).
[i]Available from Milliken Chemical Company (nominally 100%).
[j]Disodium 4,4'-bis-(2-sulfostyryl) biphenyl, available from Ciba Specialty Chemicals.
[k]Cocomethyl ethoxylated [15] ammonium chloride, available from Akzo Nobel.

The following are non-limiting examples of processes to make the compositions of the present invention.

Example VIII

Cationic Starch Admixed with Fabric Softening Active

To make a composition of the present invention with cationic starch dry powder admixed with the fabric softening active, approximately 25% of the fabric softening raw material containing the active (e.g. N,N-di(tallowoyl-oxyethyl)-N,N-dimethylammonium chloride) and ethanol is premixed with the entire desired amount of cationic starch, such as National 49–3490, then heated to 70–75° C. to fluidize the material. The remaining 75% of the fabric softening raw material is also heated to 70–75° C. to fluidize this portion. The fluidized fabric softening raw material and cationic starch mix is then combined with the remaining fluidized fabric softening raw material. Deionized water, antifoam agent (DC2310), hydrochloric acid, and a preservative (KATHON® CG) are mixed to form a water seat, and this mixture is heated to 70–75° C. The hot mixture of cationic starch and fabric softening active is pumped into the hot water seat. Both mixing and milling are employed to create the fabric softening dispersion. When the necessary amount of fabric softening active has been added to the water seat, the requisite amount of electrolyte (e.g. calcium chloride) is added in while again mixing and milling the product. The product is cooled via a plate and frame heat exchanger to approximately 22° C. The cooled product is mixed using a turbine blade at about 200 rpm, and is finished by adding the requisite amounts of phase stabilizing polymer, perfume, 25% calcium chloride, 10% ammonium chloride, and dye. Other adjunct ingredients can be added at this time, if desired.

Example IX

Gelatinized Cationic Starch Components Added into the Water

To make a composition of the present invention with gelatinized cationic starch components added into the water, the cationic starch dry powder is added to the desired amount of deionized water and cooked past the pasting temperature to a polymeric dispersion of the starch components. The remaining amount of deionized water, antifoam agent (DC2310), hydrochloric acid, and a preservative (KATHON® CG) are mixed to form a water seat, and this mixture is heated to 70–75° C. The starch component dispersion, which is kept hot following gelatinization, is added to the heated water seat. Not wishing to be bound by theory, adding the cationic starch to the water seat prior to adding the fabric softening active may allow the cationic starch to disperse more homogeneously in the water phase. A fabric softening raw material containing the active (e.g. N,N-di(tallowoyl-oxyethyl)-N,N-dimethylammonium chloride) and ethanol is heated to 70–75° C. to fluidize the material. When the fabric softening active is fluidized, it is pumped into the hot water seat which contains the cationic starch components. Both mixing and milling are employed to create the fabric softening dispersion. When the necessary amount of fabric softening active has been added to the water seat, the requisite amount of electrolyte (e.g. calcium chloride) is added in while again mixing and milling the product. The product is cooled via a plate and frame heat exchanger to approximately 22° C. The cooled product is mixed using a turbine blade at about 200 rpm, and is finished by adding the requisite amounts of soil release agent, perfume, 25% calcium chloride, 10% ammonium chloride, and dye. Other adjunct ingredients can be added at this time, if desired.

Example X

To make a spray-on composition of the present invention, the cationic starch dry powder is added to the desired amount of deionized water and cooked past the pasting temperature to a polymeric dispersion of the starch components. The remaining amount of deionized water and hydrochloric acid are mixed to form a water seat, and this mixture is heated to 70–75° C. The starch component dispersion, which is kept hot following gelatinization, is added to the heated water seat. A fabric softening raw material containing the active (e.g. N,N-di(tallowoyl-oxyethyl)-N,N-dimethylammonium chloride) and ethanol is heated to 70–75° C. to fluidize the material. When the fabric softening active is fluidized, it is pumped into the hot water seat which contains the cationic starch components. Both mixing and milling are employed to create the fabric softening dispersion. The product is cooled via a plate and frame heat exchanger to approximately 22° C. The cooled product is mixed using a turbine blade at about 200 rpm, and is finished by adding the requisite amounts of perfume and preservative (KATHON® CG). Other adjunct ingredients can be added at this time, if desired.

Example XI

A first mixture and a second mixture are prepared and then combined to form a composition of the present invention. For the first mixture, the cationic starch dry powder is added to the desired amount of deionized water and cooked past the pasting temperature to a polymeric dispersion of the starch components.

In a separate 250 mL beaker, the second mixture is prepared by sequentially adding the following ingredients with 2 minutes of stirring time on a magnetic stir plate in between addition of each ingredient: deionized water, $MgCl_2$, HCl, DTPA, Pluronic L35, 2,2,4-trimethyl-1,3-pentanediol, Varisoft® 222 LM, Adogen CDMC, perfume, Neodol 91-8, Liquitint Blue ED.

The final composition is prepared by adding first mixture to the second mixture and stirring for 10 minutes on a magnetic stir plate.

| | EXAMPLES | | | | |
|---|---|---|---|---|---|
| INGREDIENTS | XII | XIII | XIV | XV | XVI |
| Fabric Softening Active[a] | 14.00% | 14.00% | 14.00% | 14.00% | 14.00% |
| Ethanol | 2.28% | 2.28% | 2.28% | 2.28% | 2.28% |
| Cationic Starch[b] | 2.00% | 2.00% | 2.00% | 2.00% | 2.00% |
| Perfume | 1.58% | 1.58% | 1.58% | 1.58% | 1.58% |
| Phase Stabilizing Polymer[c] | 0.14% | 0.14% | 0.14% | 0.14% | 0.14% |
| Calcium Chloride | 0.200% | 0.200% | 0.200% | 0.200% | 0.200% |
| DTPA[d] | 0.007% | 0.007% | 0.007% | 0.007% | 0.007% |
| Preservative[e] | 5 ppm | 5 ppm | 5 ppm | 5 ppm | 5 ppm |
| Antifoam[f] | 0.015% | 0.015% | 0.015% | 0.015% | 0.015% |
| Acid Violet #49 | — | 60 ppm | — | — | 60 ppm |
| Liquitint Violet CT[g] | 60 ppm | — | | 20 ppm | 30 ppm |
| Liquitint Violet LS[h] | — | — | — | 150 ppm | — |
| Milliken Violet 28B[i] | | | 90 ppm | | |
| Tinopal CBS-X[j] | 0.4 | 0.4 | 0.4 | 0.4 | 0.4 |
| Ethoquad C/25[k] | 0.52 | 0.52 | 0.52 | 0.52 | 0.52 |
| Ammonium Chloride | 0.100% | 0.100% | 0.100% | 0.100% | 0.100% |
| Hydrochloric Acid | 0.014% | 0.014% | 0.014% | 0.014% | 0.014% |
| Deionized Water | Balance | Balance | Balance | Balance | Balance |
| IV of FSA[l] | 56 | 18 | 18 | 18 | 37 |
| Diester:Monoester Wt % Ratio | 2.4 | 16.3 | 4.3 | 2.4 | 4.3 |
| WF of Starch | 78 | 78 | 78 | 78 | 78 |

[a]N,N-di(tallowoyloxyethyl)-N,N-dimethylammonium chloride.
[b]Cationic starch based on common maize starch or potato starch, containing 25% to 95% amylose and a degree of substitution of from 0.02 to 0.09, and having a viscosity measured as Water Fluidity having a value from 50 to 84.

-continued

| | EXAMPLES | | | | |
|---|---|---|---|---|---|
| INGREDIENTS | XII | XIII | XIV | XV | XVI |

[c]Copolymer of ethylene oxide and terephthalate having the formula described in U.S. Pat. No. 5,574,179 at col. 15, lines 1–5, wherein each X is methyl, each n is 40, u is 4, each $R^1$ is essentially 1,4-phenylene moieties, each $R^2$ is essentially ethylene, 1,2-propylene moieties, or mixtures thereof.
[d]Diethylenetriaminepentaacetic acid.
[e]KATHON ® CG available from Rohm and Haas Co.
[f]Silicone antifoam agent available from Dow Corning Corp. under the trade name DC2310.
[g]Available from Milliken Chemical Company (nominally 100%).
[h]Available from Milliken Chemical Company (nominally 100%).
[i]Available from Milliken Chemical Company (nominally 100%).
[j]Disodium 4,4'-bis-(2-sulfostyryl) biphenyl, available from Ciba Specialty Chemicals.
[k]Cocomethyl ethoxylated [15] ammonium chloride, available from Akzo Nobel.
[l]Fabric Softening Active.

Brightener Premix

In order to effectively incorporate the brightener in a post-addition process, it is necessary to formulate a BRIGHTENER premix. Solvents and surfactants can be used, generally nonionic or cationic or mixtures. A preferred class of solvent/surfactants is monoalkyl ethoxylated ammonium chlorides, for example, cocomethyl ethoxylated [15] ammonium chloride (Ethoquad C/25, ex. Akzo).

Example XVII

The Tinopal CBS-X comes as a powder with water solubility of 2.5% at 25 C. To efficiently add this brightener to a fabric conditioning composition, a premix is made, comprised of the following:

| Ingredient | CAS# | Wt. |
|---|---|---|
| Tinopal CBS-X | 27344-41-8 | 9.6% |
| Ethoquad C/25 | 61791-10-4 | 12.5% |
| Glutaraldehyde | 111-30-8 | 0.050 |
| DI water | 7732-18-5 | balance to 100% |
| pH = 6.5 | | |

To the DI water, the Ethoquad C/25 is added and mixed to incorporate. The Tinopal CBS-X powder is added to this solution and mixed at high speed until all powder is dissolved. Glutaraldehyde is added near the end of mixing.

To further aid in the incorporation of Tinopal CBS-X into a premix and into a fabric conditioning composition, higher concentrations of Ethoquad C/25 can be used. An example of such a pre-mix composition is:

| Ingredient | CAS# | Wt. |
|---|---|---|
| Tinopal CBS-X | 27344-41-8 | 4.8% |
| Ethoquad C/25 | 61791-10-4 | 25.0% |
| Glutaraldehyde | 111-30-8 | 0.050 |
| DI water | 7732-18-5 | balance to 100% |
| pH = 6.5 | | |

| INGREDIENTS | EXAMPLE XVIII[l] | XIX | XX[m] | XXI | XXII |
|---|---|---|---|---|---|
| Fabric Softening Active[a] | 13.23% | 14.00% | 14.00% | 14.00% | 13.23% |
| Ethanol | 2.07% | 2.28% | 2.28% | 2.28% | 2.07% |
| Cationic Starch[b] | 1.89% | — | — | | 1.89% |
| Perfume | 1.30% | 1.50% | 1.50% | 1.50% | 1.30% |
| Phase Stabilizing Polymer[c] | 0.13% | 0.14% | 0.14% | 0.14% | 0.13% |
| Calcium Chloride | 0.142% | 0.150% | 0.150% | 0.150% | 0.142% |
| DTPA[d] | 0.0066% | 0.007% | 0.007% | 0.007% | 0.0066% |
| Preservative[e] | 5.0 ppm | 5.0 ppm | 5.0 ppm | 5.0 ppm | 5.0 ppm |
| Antifoam[f] | 0.014% | 0.015% | 0.015% | 0.015% | 0.014% |
| Acid Violet #49 | — | — | — | 60 ppm | — |
| Liquitint Violet CT[g] | 60 ppm | 60 ppm | | | 30 ppm |
| Liquitint Violet LS[h] | — | — | — | — | 150 ppm |
| Milliken Violet 28B[i] | | | 90 ppm | | |
| Tinopal CBS-X[j] | 0.4 | 0.4 | 0.2 | 0.2 | 0.4 |
| Ethoquad C/25[k] | 0.52 | 0.52 | 1.00 | 1.04 | 0.52 |
| Ammonium Chloride | 0.095% | 0.1% | 0.1% | 0.1% | 0.095% |
| Hydrochloric Acid | 0.008% | 0.008% | 0.008% | 0.008% | 0.008% |
| Deionized Water | Balance | Balance | Balance | Balance | Balance |

[a]N,N-di(tallowoyloxyethyl)-N,N-dimethylammonium chloride.
[b]Cationic starch based on common maize starch or potato starch, containing 25% to 95% amylose and a degree of substitution of from 0.02 to 0.09, and having a viscosity measured as Water Fluidity having a value from 50 to 84.
[c]Copolymer of ethylene oxide and terephthalate having the formula described in U.S. Pat. No. 5,574,179 at col. 15, lines 1–5, wherein each X is methyl, each n is 40, u is 4, each $R^1$ is essentially 1,4-phenylene moieties, each $R^2$ is essentially ethylene, 1,2-propylene moieties, or mixtures thereof.
[d]Diethylenetriaminepentaacetic acid.
[e]KATHON ® CG available from Rohm and Haas Co.
[f]Silicone antifoam agent available from Dow Corning Corp. under the trade name DC2310.
[g]Available from Milliken Chemical Company (nominally 100%).
[h]Available from Milliken Chemical Company (nominally 100%).
[i]Available from Milliken Chemical Company (nominally 100%).
[j]Disodium 4,4'-bis-(2-sulfostyryl) biphenyl, available from Ciba Specialty Chemicals.
[k]Cocomethyl ethoxylated [15] ammonium chloride, available from Akzo Nobel.
[l]Example XVIII has a Staining Potential Score of 2.85.
[m]Example XX has a Staining Potential Score of 3.78.

| INGREDIENTS | EXAMPLES XXIII | XXIV | XXV | XXVI | XXVII |
|---|---|---|---|---|---|
| Fabric Softening Active[a] | 14.00% | 14.00% | 14.00% | 14.00% | 13.23% |
| Ethanol | 2.28% | 2.28% | 2.28% | 2.28% | 2.07% |
| Cationic Starch[b] | 2.00% | — | 2.00% | — | 1.89% |
| Perfume | 1.30% | 1.50% | 1.50% | 1.50% | 1.30% |
| Phase Stabilizing Polymer[c] | 0.14% | 0.14% | 0.14% | 0.14% | 0.13% |
| Calcium Chloride | 0.150% | 0.150% | 0.150% | 0.150% | 0.142% |
| DTPA[d] | 0.007% | 0.007% | 0.007% | 0.007% | 0.0066% |
| Preservative[e] | 5.0 ppm | 5.0 ppm | 5.0 ppm | 5.0 ppm | 5.0 ppm |
| Antifoam[f] | 0.015% | 0.015% | 0.015% | 0.015% | 0.014% |
| Acid Violet #49 | — | — | — | 60 ppm | — |
| Liquitint Violet CT[g] | 60 ppm | — | 30 ppm | — | 30 ppm |
| Liquitint Violet LS[h] | — | | 150 ppm | | 150 ppm |
| Milliken Violet 28B[h] | — | 90 ppm | — | | |
| Ammonium Chloride | 0.1% | 0.1% | 0.1% | 0.1% | 0.095% |
| Hydrochloric Acid | 0.008% | 0.008% | 0.008% | 0.008% | 0.008% |
| Deionized Water | Balance | Balance | Balance | Balance | Balance |

[a]N,N-di(tallowoyloxyethyl)-N,N-dimethylammonium chloride.
[b]Cationic starch based on common maize starch or potato starch, containing 25% to 95% amylose and a degree of substitution of from 0.02 to 0.09, and having a viscosity measured as Water Fluidity having a value from 50 to 84.
[c]Copolymer of ethylene oxide and terephthalate having the formula described in U.S. Pat. No. 5,574,179 at col. 15, lines 1–5, wherein each X is methyl, each n is 40, u is 4, each $R^1$ is essentially 1,4-phenylene moieties, each $R^2$ is essentially ethylene, 1,2-propylene moieties, or mixtures thereof.
[d]Diethylenetriaminepentaacetic acid.
[e]KATHON ® CG available from Rohm and Haas Co.
[f]Silicone antifoam agent available from Dow Corning Corp. under the trade name DC2310.

-continued

| INGREDIENTS | EXAMPLES XXIII | XXIV | XXV | XXVI | XXVII |
|---|---|---|---|---|---|

[g]Available from Milliken Chemical Company (nominally 100%).
[h]Available from Milliken Chemical Company (nominally 100%).
[i]Available from Milliken Chemical Company (nominally 100%).

Example XXVIII

To make compositions of the present invention as shown in Examples XXIX through XXXIV the deionized water, hydrochloric acid, and calcium chloride are mixed to form a water seat, and this mixture is heated to 47–55° C. When desired, the cationic starch dry powder is added to the desired amount of deionized water (this amount of water will be subtracted from the amount added to the water seat for batches containing starch) and cooked past the pasting temperature to a polymeric dispersion of the starch components. This starch component dispersion, which is kept hot following gelatinization, is added to the heated water seat. A fabric softening raw material containing the active (e.g. methyldiethanolamine alkylesterquat) and isopropanol is heated to 68–72° C. to fluidize the material. When the fabric softening active is fluidized, it is pumped into the hot water, adding the silicone emulsion immediately before adding the fabric softening raw material. Vigorous mixing is employed to create the fabric softening dispersion. When the necessary amount of fabric softening active has been added to the water seat, the perfume and dye are added. More electrolyte (e.g. calcium chloride) may be added to achieve the desired product viscosity. The product is cooled via a cooling coil to approximately 25° C. Other adjunct ingredients can be added at this time, if desired.

| INGREDIENTS | XXIX | XXX | XXXI | XXXII | XXXIII | XXXIV |
|---|---|---|---|---|---|---|
| Fabric Softening Active[a] | 8.00% | 8.00% | 8.00% | 5.00% | 6.50% | 6.50% |
| Isopropanol | 1.32% | 1.32% | 1.32% | 0.83% | 1.07% | 1.07% |
| Cationic Starch[b] | — | — | — | 1.00% | 0.50% | 1.00% |
| Silicone emulsion SE39[c] | 0.13% | 0.11% | 0.11% | 0.11% | 0.11% | 0.11% |
| Glutaraldehyde | 0.025% | 0.025% | 0.025% | 0.025% | 0.025% | 0.025% |
| Hydrochloric Acid | 0.038% | 0.025% | 0.025% | 0.025% | 0.025% | 0.025% |
| PEI1800-E7[d] | 0.25% | — | — | — | — | — |
| Calcium Chloride | 0.15% | 0.15% | 0.15% | 0.09% | 0.12% | 0.12% |
| Perfume | 1.10% | 0.95% | 0.95% | 0.95% | 0.95% | 0.95% |
| Acid Violet #49 | 30 ppm | — | — | — | — | — |
| Liquitint Violet CT[e] | — | 20 ppm | 30 ppm | — | 30 ppm | 20 ppm |
| Liquitint Violet LS[f] | | 90 ppm | — | | — | 90 ppm |
| Milliken Violet 28B[g] | — | — | — | 50 ppm | — | — |
| Tinopal CBS-X[h] | 0.13% | — | 0.13% | 0.13% | — | 0.13% |
| Ethoquad C/25[i] | 0.17% | — | 0.17% | 0.17% | — | 0.17% |
| Deionized Water | Balance | Balance | Balance | Balance | Balance | Balance |

[a]Reaction product of fatty acid with methyldiethanolamine in a molar ratio 1.5:1, quaternized with methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.
[b]Cationic starch based on common maize starch or potato starch, containing 25% to 95% amylose and a degree of substitution of from 0.02 to 0.09, and having a viscosity measured as Water Fluidity having a value from 50 to 84.
[c]Available from Wacker.
[d]1800 MW polyethyleneimine with 7 moles of ethoxylate.
[e]Available from Milliken Chemical Company (nominally 100%).
[f]Available from Milliken Chemical Company (nominally 100%).
[g]Available from Milliken Chemical Company (nominally 100%).
[h]Disodium 4,4'-bis-(2-sulfostyryl) biphenyl, available from Ciba Specialty Chemicals.
[i]Cocomethyl ethoxylated [15] ammonium chloride, available from Akzo Nobel.

| INGREDIENTS | EXAMPLES XXXV | XXXVI | XXXVII | XXXVIII | XXXIX | XL | XLI |
|---|---|---|---|---|---|---|---|
| Fabric Softening Active[a] | 14.00% | 14.00% | 14.00% | 14.00% | 14.00% | 14.00% | 14.00% |
| Ethanol | 2.18% | 2.18% | 2.18% | 2.18% | 2.18% | 2.18% | 2.18% |
| Cationic Starch[b] | 2.00% | 2.00% | 2.00% | 2.00% | 2.00% | 2.00% | 2.00% |
| Perfume | 1.45% | 1.45% | 1.45% | 1.45% | 1.45% | 1.45% | 1.45% |
| Phase Stabilizing Polymer[c] | 0.14% | 0.14% | 0.14% | 0.14% | 0.14% | 0.14% | 0.14% |
| Calcium Chloride | 0.150% | 0.150% | 0.150% | 0.150% | 0.150% | 0.150% | 0.150% |
| DTPA[d] | 0.005% | 0.005% | 0.005% | 0.005% | 0.005% | 0.005% | 0.005% |
| Preservative[e] | 5 ppm | 5 ppm | 5 ppm | 5 ppm | 5 ppm | 5 ppm | 5 ppm |
| Antifoam[f] | 0.011% | 0.011% | 0.011% | 0.011% | 0.011% | 0.011% | 0.011% |

-continued

| INGREDIENTS | EXAMPLES XXXV | XXXVI | XXXVII | XXXVIII | XXXIX | XL | XLI |
|---|---|---|---|---|---|---|---|
| Tinopal ® CBS-X[g] | 0.20 | 0.20 | 0.20 | 0.20 | 0.20 | 0.20 | 0.20 |
| Liquitint Violet CT[h] | 30 ppm | 30 ppm | 30 ppm | 30 ppm | 30 ppm | 30 ppm | 30 ppm |
| Liquitint Violet LS[i] | 150 ppm | 150 ppm | 150 ppm | 150 ppm | 150 ppm | 150 ppm | 150 ppm |
| Ethoquad ® C/25[j] | 1.00% | — | — | — | — | — | — |
| Ethoquad ® 18/25[k] | — | 1.00% | — | — | — | — | — |
| Pluronic ® L-8[l] | — | — | 1.50% | — | — | — | — |
| C18 Alkyl Amine Oxide | — | — | — | 2.00% | — | — | — |
| PEI189-E15[m] | — | — | — | — | 2.00% | — | — |
| Polectron ® 430[n] | — | — | — | — | — | 1.50% | — |
| Titanium Dioxide ($TiO_2$) | — | — | — | — | — | — | 1.00% |
| Ammonium Chloride | 0.1% | 0.1% | 0.1% | 0.1% | 0.1% | 0.1% | 0.1% |
| Hydrochloric Acid | 0.012% | 0.012% | 0.012% | 0.012% | 0.012% | 0.012% | 0.012% |
| Deionized Water | Balance | Balance | Balance | Balance | Balance | Balance | Balance |

[a]N,N-di(tallowoyloxyethyl)-N,N-dimethylammonium chloride.
[b]Cationic starch based on common maize starch or potato starch, containing 25% to 95% amylose and a degree of substitution of from 0.02 to 0.09, and having a viscosity measured as Water Fluidity having a value from 50 to 84.
[c]Copolymer of ethylene oxide and terephthalate having the formula described in U.S. Pat. No. 5,574,179 at col. 15, lines 1–5, wherein each X is methyl, each n is 40, u is 4, each $R^1$ is essentially 1,4-phenylene moieties, each $R^2$ is essentially ethylene, 1,2-propylene moieties, or mixtures thereof.
[d]Diethylenetriaminepentaacetic acid.
[e]KATHON ® CG available from Rohm and Haas Co.
[f]Silicone antifoam agent available from Dow Corning Corp. under the trade name DC2310.
[g]Disodium 4,4'-bis-(2-sulfostyryl) biphenyl, available from Ciba Specialty Chemicals.
[h]Available from Milliken Chemical Company (nominally 100%).
[i]Available from Milliken Chemical Company (nominally 100%).
[j]Cocomethyl ethoxylated [15] ammonium chloride, available from Akzo Nobel.
[k]Octadecylmethyl ethoxylated [15] ammonium chloride, available from Akzo Nobel.
[l]Nonionic surfactant available from BASF.
[m]Ethoxylated (15) tetraethylene pentaimine.
[n]Co-polymers containing vinypyrrolidone and styrene, available from ISP.

The fabric conditioning composition examples are added to the rinse cycle of a machine wash (or hand washing) laundering process. A typical bundle size is about 5.5 lb., but can be larger, about 7.5 lb. per load. The water fill is typically about 64 liters for a machine wash, but can be larger or smaller depending on the load size. The compositions are recommended to be dosed at about 30 g per load for ultra concentrated compositions or about 90 g per load for regular concentrated compositions. Generally, performance can be increased by using more of the compositions in a load.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and claims, are by weight and all numerical limits are used with the normal degree of accuracy afforded by the art, unless otherwise specified.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric conditioning composition comprising:

(a) a fabric care active;

(b) a hueing dye, wherein the hueing dye has:

(i) a hueing efficiency value greater than about 20, and (ii) a wash removal value from about 50% to about 98%;

(c) a brightener;

(d) a Stain Reducing Agent having a staining index less than about 90 , said Stain Reducing Agent comprising an ethoxylated monoalkyl quaternary surfactant.

2. The composition of claim 1, wherein the brightener is chosen from at least one of the following: Disodium 4,4'-bis-(2-sulfostyryl) biphenyl; Benzenesulfonic acid, 2,2'-(1,2-ethenediyl)bis[5-[4-[(2-hydroxyethyl)methylamino]-6-(phenylamino)-1,3,5-triazin-2-y]amino]-, disodium salt; Disodium 4,4'-bis {[4anilino-6-[bis(2-hydroxyethyl)amino-s-triazin-2yl]-amino}-2,2'-stilbenedisulfonate; Disodium 4,4'-bis[(4-anilino-6-(N-2-hydroxyethyl-N-methylamino)-s-triazine-2-yl)amino]2,2'-stilbenedisulfonate; Disodium 4,4'-bis{[4-anilino-6methylamino-s-triazin-2-yl]amino}-2,2'-stilbenedisulfonate; Disodium 4,4"-bis[4,6-di-anilino-s-triazin-2-yl]-2,2'-stilbenedisulfonate; Disodium 4,4'-bis{[4-anilino-6-morpholino-s-triazin-2-yl}-amino}-2,2'-stilbenedisulfonate.

3. The composition of claim 1, wherein the brightener is Disodium 4,4'-bis-(2-sulfostyryl) biphenyl and wherein the Stain Reducing Agent is an ethoxylated monoalkyl quaternary compound.

4. The composition of claim 3, wherein the composition has a Reflectance K/S Value of from about 560 nm to about 620 nm.

5. The composition of claim 4, wherein the hueing dye level is from about 0.00001% to about 1% by weight of the composition.

6. The composition of claim 5, wherein the brightener level is from about 0.01% to about 5% by weight of the composition.

7. The composition of claim 6, further comprising a cationic polymer.

8. The composition of claim 7, wherein the cationic polymer is a cationic polysaccharide.

9. The composition of claim 8, wherein the cationic polysaccharide is a cationic starch.

* * * * *

UNITED STATES PATENT AND TRADEMARK OFFICE

CERTIFICATE OF CORRECTION

PATENT NO. : 7,235,518 B2
APPLICATION NO. : 11/244774
DATED : June 26, 2007
INVENTOR(S) : Lisa Grace Brush et al.

It is certified that error appears in the above-identified patent and that said Letters Patent is hereby corrected as shown below:

Column 5
Line 26, delete "3,157,663" and insert -- 3,157,633 --.

Signed and Sealed this

Twentieth Day of November, 2007

JON W. DUDAS
*Director of the United States Patent and Trademark Office*